United States Patent [19]

Braun et al.

[11] 4,312,750

[45] Jan. 26, 1982

[54] GRAIN CLEANING APPARATUS

[75] Inventors: Keith A. Braun, Northwood; John F. Johannsen, Rockford, both of Iowa

[73] Assignee: David Manufacturing Co., Mason City, Iowa

[21] Appl. No.: 177,071

[22] Filed: Aug. 11, 1980

[51] Int. Cl.[3] ..... B07B 1/24

[52] U.S. Cl. ..... 209/291; 209/297; 209/421

[58] Field of Search ..... 209/290, 291, 284, 420, 209/294, 297, 288, 270, 300, 421, 298

[56] References Cited

U.S. PATENT DOCUMENTS

| | | | |
|---|---|---|---|
| 4,169 | 9/1845 | Cooley | 209/291 X |
| 253,452 | 2/1882 | Weber | 209/291 |
| 332,250 | 12/1885 | Gray | 209/291 |
| 343,761 | 6/1886 | Dougan | 209/284 |
| 387,204 | 8/1888 | Beeman | 209/291 |
| 393,825 | 12/1888 | Gray | 209/290 |
| 419,696 | 1/1890 | Merrell | 209/291 |
| 433,096 | 7/1890 | Sadravezt | 209/291 |
| 455,601 | 7/1891 | Parker | 209/291 |
| 889,433 | 6/1908 | Brewster | 209/284 |
| 1,066,558 | 7/1913 | Welch | 209/291 |
| 1,088,117 | 2/1914 | Walter | 209/291 X |
| 1,305,223 | 5/1919 | Kinread | 209/291 X |
| 1,581,686 | 4/1926 | O'Toole | 209/291 X |
| 1,613,553 | 1/1927 | Arthur | 209/294 X |
| 1,617,688 | 2/1927 | O'Toole | 209/284 |
| 2,601,924 | 7/1952 | Gonder | 209/291 X |
| 3,394,808 | 7/1968 | Thompson | 209/291 X |

FOREIGN PATENT DOCUMENTS

| | | | |
|---|---|---|---|
| 629146 | 7/1927 | France | 209/291 |
| 730276 | 5/1932 | France | 209/290 |
| 2011 | of 1878 | United Kingdom | 209/290 |

*Primary Examiner*—Robert Halper

*Attorney, Agent, or Firm*—Merchant, Gould, Smith, Edell, Welter & Schmidt

[57] ABSTRACT

A grain cleaning apparatus (10) for removing coarse and fine foreign materials from dirty grain before storage. The grain cleaning apparatus includes counter-rotating screen drums (18,20). Dirty grain is received in a frusto-conically shaped inner drum (18). Coarse foreign materials are prevented from passing through screen (100) of inner drum (18) and rather move to chute (38) where they fall to trough (40) for exiting from apparatus (10). Chute (38) is located between the output end (36) of the inner drum (18) and the output end (48) of the cylindrical outer drum (20). Grain is prevented from passing through screen (115) of outer drum (20). Fine foreign materials do pass therethrough, however, for exiting from apparatus (10). Clean grain drops from the output end (48) of outer drum (20).

A motor (22) drives a secondary drive shaft (24). Shaft (24) drives first and second pulley systems (26,28) to rotate inner and outer screen drums (18,20) in opposite directions simultaneously.

11 Claims, 6 Drawing Figures

GRAIN CLEANING APPARATUS

FIELD OF THE INVENTION

This invention relates to the field of material separating devices and, more particularly, to apparatus which remove coarse and fine foreign materials from dirty grain as the grain is being transferred from a truck or other carrier to a storage bin.

BACKGROUND OF THE INVENTION

Apparatus for separating mixtures having particles of various sizes are known. For example, U.S. Pat. No. 433,096 showed a flour separator. The device included two counter-rotating, concentric, cylindrical screen drums. The drums were downwardly inclined from the input to the output ends with respect to a horizontal line to utilize the gravitational force to keep flour flowing. Flour having particles of various sizes was introduced into the inner drum at the input end. The inner drum had screen with openings which prevented coarse particles of flour from passing therethrough. The outer drum had screen with openings which allowed only small or fine particles to pass therethrough. As the flour proceeded, the fine particles dropped through both screen drums into a trough having an auger therein which moved the fine particles to a spout. The middling particles dropped through the screen openings of the inner screen drum only and proceeded to the output end of the outer drum to fall into a spout. With the output end of the inner drum extending beyond the output end of the outer drum, the coarse particles proceeded to the output end of the inner drum and dropped into a spout. An expensive-appearing planetary gear arrangement was used to drive the screen drums in counter-rotating directions.

Grain cleaning separators are also known. The known devices, however, have included concentric screen drums rotating in the same direction at the same speed. As a result, the devices have had limited capacity. When both drums operated at the same rotational speed, the surface speed of the inner drum was slower than the surface speed of the outer drum. As a consequence, grain was processed more slowly through the inner drum than the outer drum, restricting the rate of flow to the capacity of the slower, inner drum. This problem has been addressed and solved in the present invention.

SUMMARY OF THE INVENTION

The present invention is directed to an apparatus for cleaning dirty grain. The apparatus includes a frame and first and second screen means. The first screen means receives dirty grain and separates coarse foreign materials from the grain. The first screen means is rotatably attached to the frame and has input and output ends. The second screen means receives the grain from the first screen means and separates fine foreign materials from the grain. The second screen means is encircled about the first screen means and is rotatably attached to the frame. The second screen means also has input and output ends. The apparatus further includes means for rotating the first and second screen means simultaneously in opposite directions. The apparatus also includes means for advancing the grain in a longitudinal direction from the input end of the first screen means to the output end of the second screen means. In addition, the apparatus includes means for removing the coarse and fine materials from the apparatus within the longitudinal distance between the input end of the first screen means and the output end of the second screen means. Thus, the dirty grain at the input end of the first screen means is cleaned of coarse and fine foreign materials as it advances to the output end of the second screen means.

In a preferred embodiment, the present invention is comprised of a wheeled frame with a hitch. An inner frusto-conical, screened drum and an outer, cylindrical screened drum have the same axis and are rotatably attached to the frame. The screened drums are counter-rotatingly driven by first and second pulley systems connected to a common shaft driven by a motor. Dirty grain is received by the inner, frusto-conical drum and expelled as clean grain by the outer, cylindrical drum. The outer, cylindrical drum includes a trash chute mechanism for catching coarse foreign materials dropping from the output end of the inner frusto-conical drum. The chute opens into a trough formed beneath the two screened drums. Fine foreign materials drop through both screened drums to the trough. The trough includes an auger for moving the foreign materials to an exit opening.

In operation, a jack attached to the apparatus is used to adjust the orientation of the apparatus so grain will move under the influence of gravity from the input end to the output end. Dirty grain is received at the input end of the inner, frusto-conical screened drum. The inner drum includes tumbler bars which tumble and turn the grain as the drum rotates. The grain and fine foreign materials pass through the openings in the screen of the inner drum. The conical angle of the side with respect to the axis of the inner drum prevents the grain from flowing to the output end. The coarse foreign materials, however, ride on top of the grain and proceed to the output end of the inner drum, only to fall into the chute and drop to the trough below. The grain and fine foreign materials drop onto the cylindrical outer drum rotating in the opposite direction as the inner drum. The outer drum also includes tumbler bars which tumble and turn the grain as the drum rotates. The fine foreign materials pass through the openings in the screen of the outer drum and drop into the trough below or onto the ground. All foreign materials are moved by an auger within the trough to an exit opening. The cleaned grain moves under the force of gravity to the output end of the outer drum where it drops from the apparatus.

The present invention is particularly advantageous in that the two pulley systems not only drive the inner and outer drums in counter-rotating directions, resulting in a reduced probability of plugging, but also drive the drums at different rotational speeds, resulting in increased capacity. Counter-rotation of the drums results in grain being distributed over a larger area in the outer drum than would otherwise be the case if the two drums were rotating in the same direction. Additionally, the frusto-conical shape of the inner drum results in the wall of the inner drum rising away from the wall of the outer drum leaving more space between the two drums as the grain moves toward the output end of the outer drum. These features combine to reduce the possibility of plugging the apparatus. The capability of driving the drums at different rotational speeds allows the drums to be driven such that the average surface speeds of the two drums are approximately the same. Approximately equal surface speeds results in grain being cleaned at approximately the same rate by both drums. As a consequence, both drums can be operated at full capacity allowing the apparatus to show greatly increased efficiency and capacity over earlier devices.

Capacity is also increased because the apparatus may be inclined to provide rapid flow of grain from the input end of the apparatus to the output end. The incline is limited only by the conical angle of the inner drum which prevents the grain from moving to the trash chute before it passes through the screen of the inner drum.

A further advantage of the present invention is that all foreign materials are removed from the grain between the input and output ends of the apparatus. As a consequence, the apparatus may be easily inserted between a grain truck and an elevating auger which lifts grain into a storage bin.

These various advantages and features of novelty which characterize the invention are also pointed out in the claims annexed hereto and forming a part hereof. For a better understanding of the invention, its advantages, and objects obtained by its use; however, reference should be had to the drawings and to the accompanying descriptive matter which form a further part hereof, in which there are illustrated and described preferred embodiments of the invention.

DETAILED DESCRIPTION OF THE INVENTION

Figure 1:
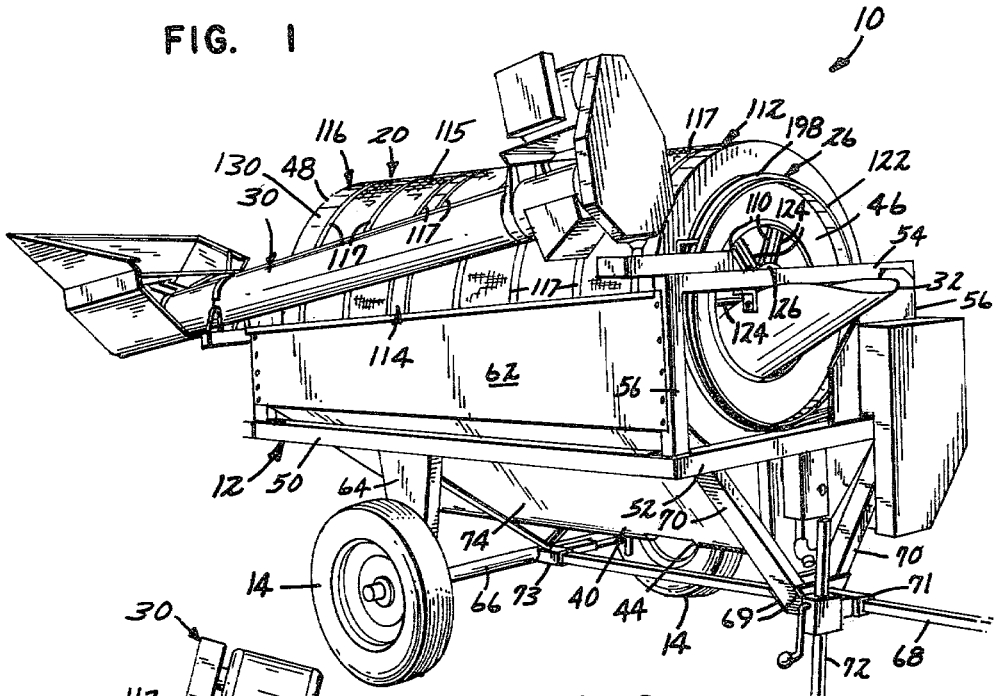
FIG. 1 is a perspective view of a grain cleaning apparatus in accordance with the present invention.
Figure 4:
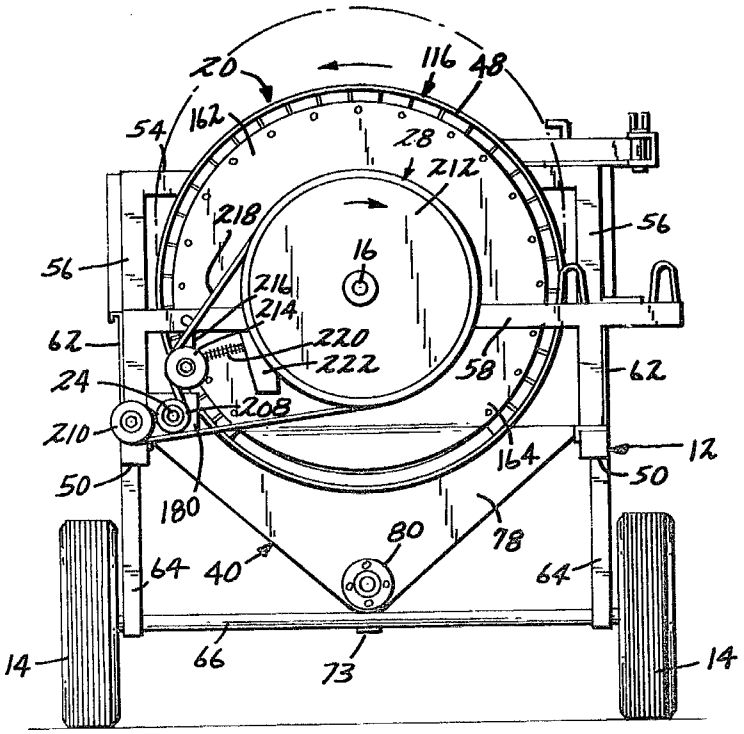
FIG. 4 is a rear view of the present invention.
Figure 5:
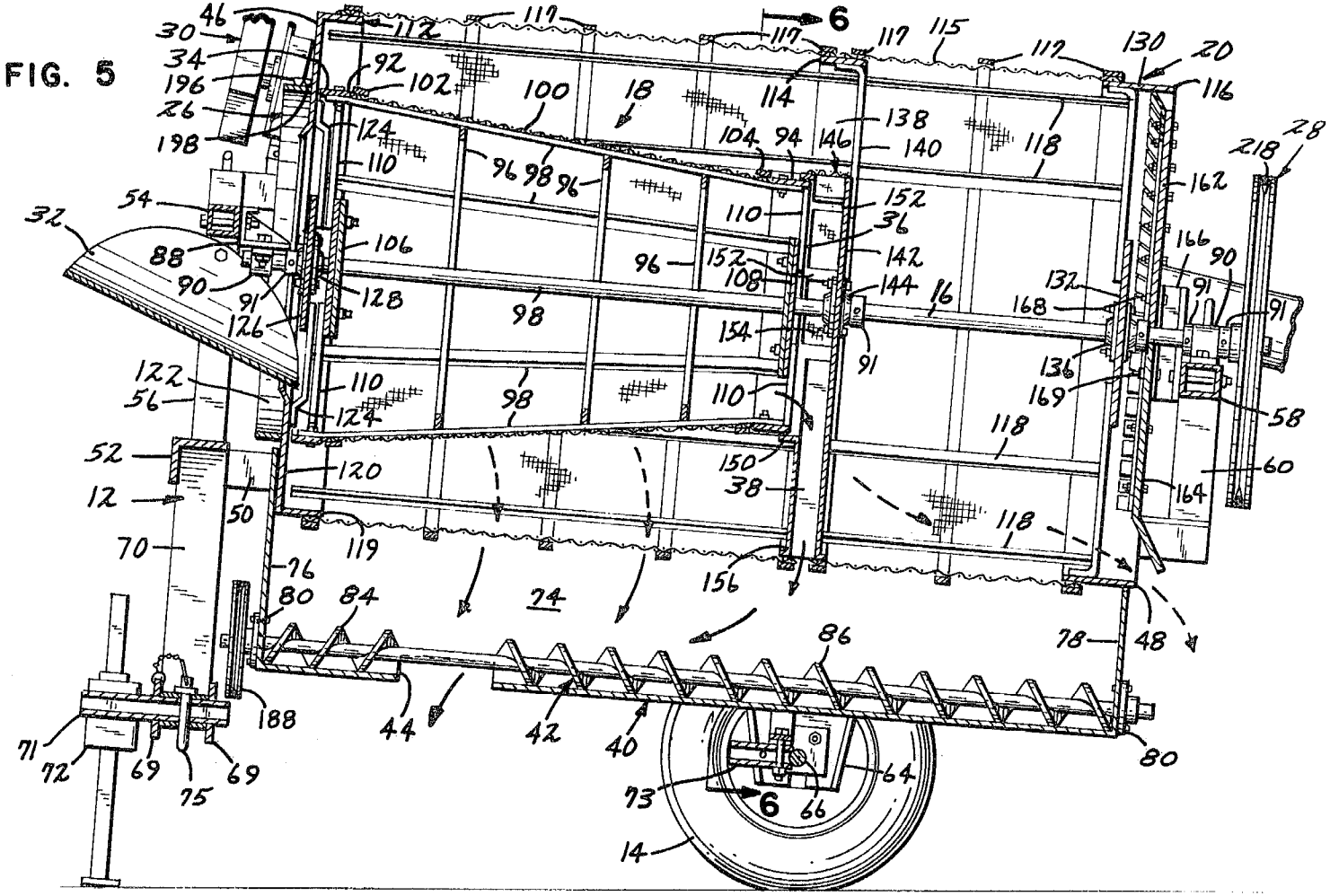
FIG. 5 is a cross-sectional view, taken along line 5—5 of FIG. 3.

Referring now to the drawings wherein like reference numerals designate identical or corresponding parts throughout the several views, there is shown in FIG. 1 a grain cleaning apparatus in accordance with the present invention designated generally as 10. Grain cleaning apparatus 10 includes a frame 12 mounted on wheels 14. As shown in FIG. 5, a rotatable support shaft 16 is mounted to frame 12. Both an inner, frusto-conical screened drum 18 and an outer, cylindrical screened drum 20 are mounted on support shaft 16; outer drum 20 being rotatably mounted. The driving source for screened drums 18 and 20 is motor 22 (see FIG. 2). Motor 22 and a primary pulley system rotatingly drive a secondary drive shaft 24 which extends the length of apparatus 10. A first pulley system 26 (see FIG. 3) is connected to secondary drive shaft 24 to drive outer drum 20 in a clockwise direction as viewed from the front or input end of apparatus 10. A second pulley system 28 (see FIG. 4) is connected to secondary drive shaft 24 near its rear end to drive inner drum 18 in a counter-clockwise direction as viewed from the front or in a clockwise direction as viewed from the back as shown in FIG. 4. As shown in FIG. 1, a feed-in auger assembly 30, not needed for the present invention, may be carried as a part of apparatus 10 and used to move grain from a transport truck to the input pan 32 for delivery into the input end 34 of inner drum 18. Inner drum 18 separates coarse foreign materials from the dirty grain. The coarse foreign materials are moved to the output end 36 (see FIG. 5) of inner drum 18 where they fall into chute 38 for passage to trough 40. Outer drum 20 separates the fine foreign materials from the grain. The fine foreign materials drop through the screen of outer drum 20 into trough 40. As shown in FIG. 5, the foreign materials are moved by auger 42 to opening 44 in trough 40 for exit from apparatus 10. The clean grain flows under the force of gravity from the input end 46 of outer drum 20 to the output end 48. The clean grain drops from the output end 48 of outer drum 20 presumably into an elevating auger or other apparatus for movement into a grain storage bin.

More particularly, frame 12 is comprised of a plurality of structural members such as channels, angles, square tubes or other structurally-shaped members. The members are fastened together using welds, nuts and bolts, or other commonly known fastening mechanisms. As shown in FIG. 1, side members 50 are fastened to a front, lower end member 52 to form three sides of a horizontal rectangle. Front, upper end member 54 is supported parallel to and above front, lower end member 52 by supports 56. Rear, upper end member 58 (see FIG. 4) extends between side members 50 and is supported at an elevated distance above side members 50 by supports 60. Front supports 56 are somewhat longer than rear supports 60 to support front, upper end member 54 at a higher elevation than rear, upper end member 58. Side panels 62 extend on either side of apparatus 10 between supports 56 and 60 to prevent an operator from inadvertently coming into contact with the rotating outer drum 20 and to direct fine and coarse materials from drums 18, 20 into trough 40. Side panels 62 are fastened to supports 56 and 60 in a standard fashion, for example, with nuts and bolts.

Struts 64 extend downwardly from side members 50 at a location somewhat rearward of the midpoint of side members 50. Struts 64 are supported by axle 66, being attached thereto in a commonly-known fashion. Wheels 14 are rotatably attached to axle 66. Detachable tongue 68 extends forwardly from the midpoint of axle 66. Diagonal members 70 extend diagonally downward from approximately the ends of forward, lower end member 52. Two laterally-directed plates 69 on either side of diagonal members 70 hold the lower ends of the diagonal members 70 in place. Sleeve 71 extends longitudinally through both plates 69. A commonly known jack mechanism 72 is attached to sleeve 71 somewhat forwardly of the location where diagonal members 70 meet. Jack mechanism 72 functions to elevate the front or input end of grain cleaning apparatus 10 in order that the grain may be advanced under the force of gravity from the input to the output end. Tongue 68 is slidably encased in sleeve 71 and held at its rear end by a box structure 73 attached to axle 66. Tongue 68 is detachably prevented from sliding within sleeve 71 by pin 75.

Although wheels 14 provide apparatus 10 a portable capability, wheels 14 and the hitching mechanism are not needed to practice the present invention. Other framework obvious to one skilled in the art may be utilized to support apparatus 10 relative to the ground. In addition, such framework may position said apparatus so that grain naturally flows under the influence of gravity eliminating the need for said jack mechanism 72.

As shown in FIG. 5, trough 40 includes diagonal panels 74 extending diagonally downwardly from side members 50 to meet one another for attachment with nuts and bolts. Front panel 76 and rear panel 78 are triangularly shaped and fastened to diagonal panels 74. Bearings 80 are fastened to the outer sides of front panel 76 and rear panel 78 to rotatingly support auger 42 near the bottom of the V-portion of trough 40. Auger 42 has a forward set of flights 84 and a rearward set of flights 86. With auger 42 turning clockwise as viewed from the front of apparatus 10, flights 84 move material rearward to opening 44 in trough 40. At the same time, flights 86 move material forward to opening 44. Thus, auger 42 functions to move all materials within trough 40 toward opening 44.

Inner and outer screened drums 18 and 20, respectively, are supported by support shaft 16. Shaft 16 is rotatably supported by frame 12. Shaft 16 extends the longitudinal length of apparatus 10 between the front and rear, upper end members 54 and 58, respectively. An angle bracket 88 is fastened beneath front, upper end member 54 with a bearing 90 fastened beneath bracket 88 to support the forward end of shaft 16. Another bearing 90 is fastened to the top of rear, upper end member 58. Shaft 16 is held longitudinally relative to bearings 90 with appropriate collars 91 or in any other commonly known way. Shaft 16 is centered between the sides of apparatus 10. Shaft 16 is approximately parallel with the rectangle-like portion of frame 12 comprised of side members 50 and lower end member 52.

One method of introducing dirty grain into apparatus 10 is by directing a stream of grain into pan 32 so it may slide therefrom into the input end 34 of inner screened drum 18. Inner screened drum 18 is frusto-conically shaped. The larger end of inner drum 18 is the input end 34. The smaller end is the output end 36. The conical angle ensures that the grain does not flow from the input end 34 to the output end 36 even though apparatus 10 is inclined downwardly from input to output ends. The angle is not so great, however, as to prevent coarse foreign materials from moving along the top of the grain from the input end 34 to the output end 36 of inner drum 18. Thus, with the axis of drums 18 and 20 inclined downwardly to provide a desirable grain flow rate along outer drum 20, for example 10 to 20 degrees, the lowermost side of inner drum 18 is generally horizontal or inclined upwardly.

As shown in FIG. 5, inner drum 18 includes a large ring member 92 which forms the larger or input end 34 and a small ring member 94 which forms the smaller or output end 36. The framework for inner drum 18 includes a plurality of different diameter ring members 96 spaced between large ring member 92 and small ring member 94. The diameters of ring members 96 depend on the longitudinal location within the cone envelope at which specific ring members 96 are located. Rings 96 restrict grain from flowing too rapidly, giving it more time to fall through screen 100. A plurality of tumbler bars 98 extend between and are fastened to large ring member 92 and small ring member 94 to provide support for screen 100 which is wrapped thereon. Commonly-known screen clamps (not shown) hold screen 100 to tumbler bars 98. Additionally, commonly-known clamps 102 and 104 encircle inner drum 18 near large ring member 92 and small ring member 94 respectively, to hold screen 100 to the indicated framework. Screen 100 is a wire mesh having openings sufficiently large to allow passage of the grain, although not so large that trash larger than the grain may pass therethrough. As inner drum 18 rotates, the tumbler bars 98 function to turn and mix the grain giving it a better opportunity to come into contact with the screen in order to pass therethrough.

Forward hub 106 and rearward hub 108 are fixedly fastened with a clamp, setscrew, weld or other common device to shaft 16. Disk-like hubs 106 and 108 are spaced apart approximately the same distance as large ring member 92 and small ring member 94. A plurality of spokes 110 extend between large ring member 92 and hub 106 and between small ring member 94 and hub 108. Spokes 110 are fastened at both ends in a common manner. Hubs 106 and 108 are located along shaft 16 so that inner drum 18 is positioned to receive dirty grain from pan 32.

With inner drum 18 having separated the coarse foreign materials from the grain, the grain falls onto the inner surface of outer screened drum 20. Outer screened drum 20 is cylindrically shaped. The framework for outer drum 20 includes three spaced-apart, drum supporting ring members 112, 114, 116 held relative to one another by a plurality of circumferentially spaced tumbler bars 118 fastened thereto. Screen 115 is wrapped in the shape of a cylinder about the indicated framework to form drum 20. A plurality of commonly-known clamps 117 encircle outer drum 20 to hold screen 115 to the indicated framework. Screen 115 is a wire mesh having openings sufficiently small to prevent grain from passing therethrough, although not so small that fine foreign materials smaller than the grain cannot pass through. As outer drum 20 rotates, tumbler bars 118 function to turn and mix the grain, thereby making it more likely that the fine foreign materials will come into contact with the screen 115 for passage therethrough.

Input end ring member 112 includes a cylindrical wall 119 with a flat plate ring 120 attached to the outer edge of cylindrical wall 119, that is, the edge opposite ring members 114 and 116. Ring 120 is flared outwardly near its inner diameter. The inner diameter of ring 120 is somewhat smaller than the diameter of inner drum 18 at its input end 34. A short cylinder 122 having a diameter larger than the inner diameter of ring 120 and smaller than the diameter of cylindrical wall 119 is attached to the flared side of ring 120. Cylinder 122 functions as a pulley for driving outer drum 20. A plurality of spokes 124 extend between and are attached at the ends thereof to ring 120 and disk-like hub 126. Hub 126 is rotatingly supported on shaft 16 by bearing 128 centered on and attached to hub 126 in a commonly known manner.

Output end ring member 116 includes a cylindrical wall 130, a disk-like hub 132, and spokes 134 extending therebetween and attached at the ends thereto. Hub 132 is supported on shaft 16 with a bearing 136 centered on and fastened to hub 132 in a commonly known manner.

Central ring member 114 includes a cylindrical wall 138 attached with spokes 140 to a disk 142 functioning as a hub. Bearing 144 is centered on and attached to disk 142 in a commonly known manner. Bearing 144 supports ring member 114 on shaft 16. Disk 142 has a diameter slightly larger than the diameter of the output end 36 of inner drum 18. A trash screen 146 is cylindrically shaped with a diameter approximately the same as disk 142 and is attached to disk 142, extending away from disk 142 toward the input end 46 of outer drum 20. A chute 38 extends between trash screen 146 and cylindrical wall 138.

The framework for trash screen 146 is comprised of a ring 150 spaced-apart from disk 142 and held in position by a plurality of circumferentially-spaced bars 152 extending between ring 150 and disk 142. A screen 154, having perforations the same as screen 100 for inner drum 18, is wrapped about the indicated framework from one side of chute 38 to the other. Screen 154 is held to bars 152 with commonly known screen clamps (not shown).

Figure 6:
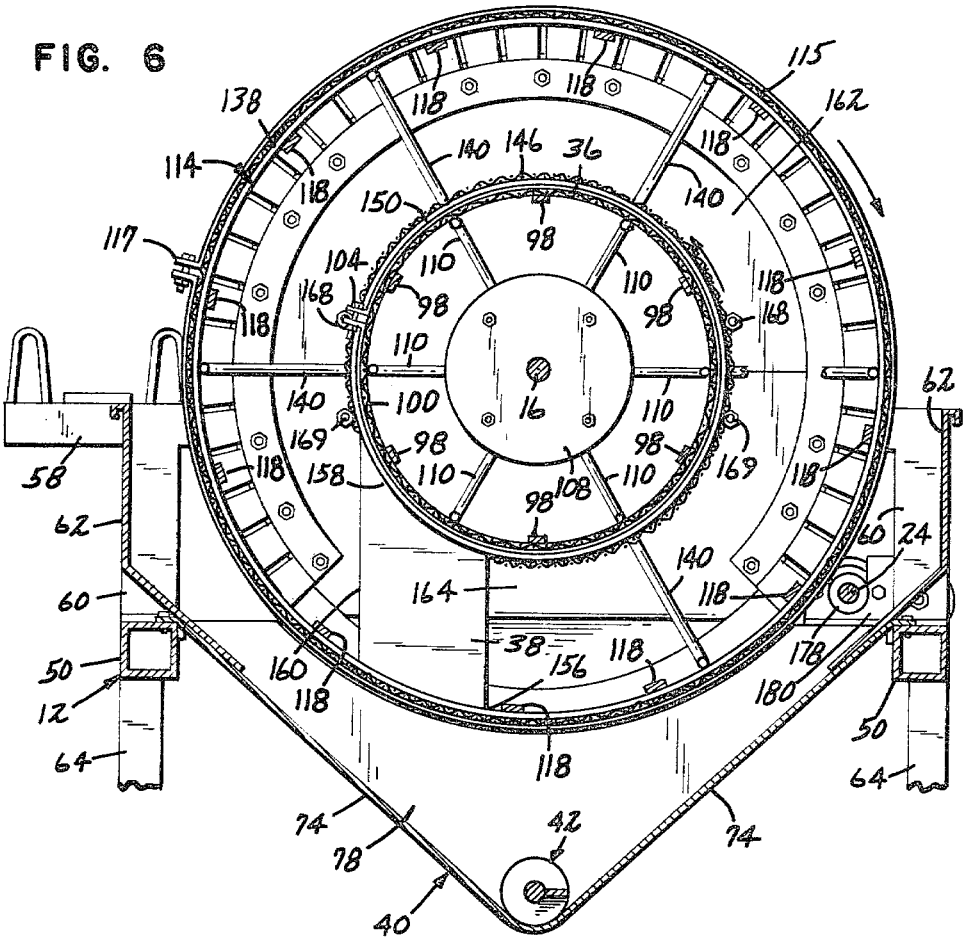
FIG. 6 is a sectional view, taken along line 6—6 of FIG. 5, illustrating the chute which removes coarse foreign materials from the inner drum.

As shown in FIGS. 5 and 6, chute 38 is essentially a four-sided rectangular box which has both ends open. Chute 38 is offset in the rotational direction of outer drum 20, and is oriented parallel to a radial line extending from the axis of outer drum 20. The outer end 156 is fastened flush to cylindrical wall 138 of outer drum 20. The inner end 158 of box 38 may be perpendicular to the sides of box 38 or flush with screen 146. Chute 38 extends inwardly to a point where the rotationally-leading side 160 just meets trash screen 146. Chute 38 is fastened to disk 142 and ring 150 using a weld, nuts and bolts or other commonly known fastening devices.

Inner screened drum 18 is approximately two-thirds the length of outer screened drum 20. Inner screened drum 18 is positioned along shaft 16 such that grain flowing across pan 32 drops through input end 34 and onto the inner surface of inner screened drum 18. Pan 32 is approximately centered on front, upper end member 54 of frame 12, and held in place by brackets and nuts and bolts in a manner obvious to one skilled in the art. Outer screened drum 20 is positioned along shaft 16 such that ring 120 of drum supporting ring member 112 is somewhat outwardly from the input end 34 of inner drum 18. Thus, pan 32 must extend through the open, inner diameter space of ring 120 in order to direct grain through ring 120 into inner drum 18. Central, drum-supporting ring member 114 is positioned so that trash screen 146 encircles at least a portion of small ring member 94 of inner drum 18. In this manner, coarse foreign materials or trash passing through the output end 36 of inner drum 18 are caught and retained in trash screen 146 with disk 142 functioning as a stop or cover. Output end, drum-supporting ring member 116 is located somewhat forwardly of the end of frame 12 represented by upper end member 58 and supports 60.

As shown in FIG. 5, an upper discharge shield 162 and a lower discharge shield 164 are located between hub 132 or ring member 116 and upper end member 54. Brackets 166 attached to upper end member 58 with nuts and bolts or other commonly known fastening devices are attached to hold upper discharge shield 62 with nuts and bolts 168. Lower discharge shield 164 is fastened to upper discharge shield 162 with nuts and bolts 169 or other commonly known devices. Upper discharge shield 162 is flared on its inner side and extends within output end ring member 116 in order to provide a non-rotating end wall for outer drum 20.

Figure 2:
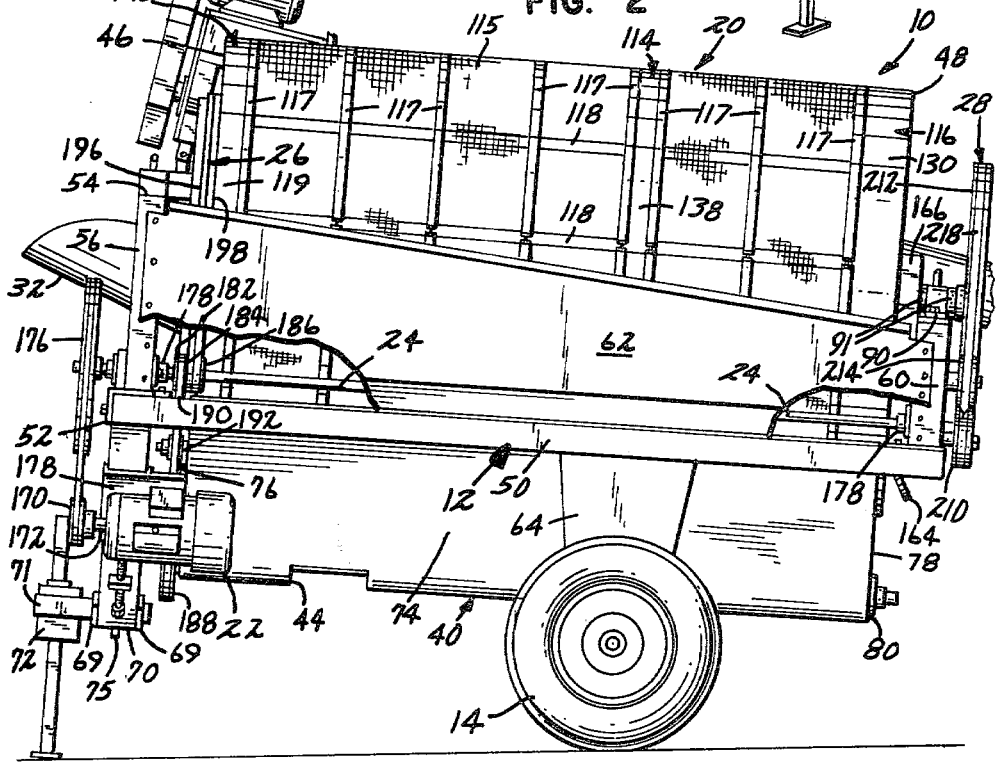
FIG. 2 is a side view with portions partially cut away.
Figure 3:
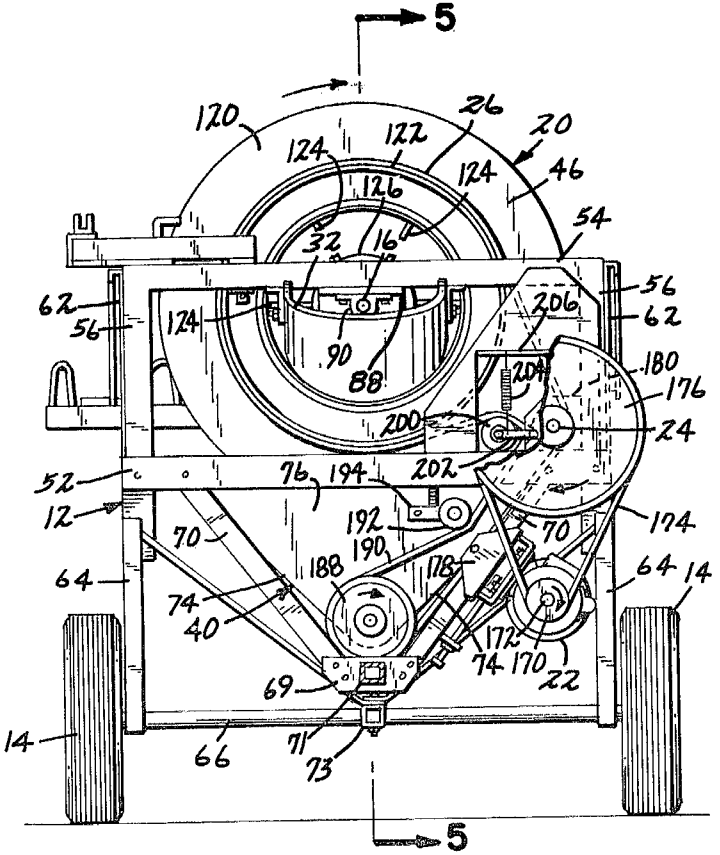
FIG. 3 is a front view of the present invention.

Inner and outer drums 18 and 20, respectively, are driven in counterrotating directions by motor 22 and first and second pulley systems 26 and 28, respectively. As shown in FIGS. 2 and 3, motor 22 has a primary drive pulley 170 fastened to the primary drive shaft 172 of motor 22. Primary belt 174, wrapped about a portion of primary drive pulley 170, drives a primary driven pulley 176 fastened to the forward end of secondary drive shaft 24. Motor 22 is positioned on a bracket structure 178 which is fastened to a diagonal member 70. Bracket structure 178 and the fastening elements therewith are commonly known to those skilled in the art. Pulleys 170 and 176 are outwardly from and approximately parallel with supports 56 for upper end member 54.

Secondary drive shaft 24 is rotatingly attached to frame 12 at support 56 in front and support 60 in the rear with bearings 178 attached in a common manner to brackets 180. Three small secondary drive pulleys are fastened to secondary drive shaft 24 between bracket 180 at the input end of apparatus 10 and the input end 46 of outer drum 20. The outer secondary drive pulley 182 is aligned with a larger driven pulley 188 fastened on the shaft of trash auger 42. First pulley 182 drives trash auger pulley 188 with belt 190. Idler pulley 192 is rotatingly attached to a bracket 194 known to those skilled in the art mounted on end wall 76. Idler pulley 192 may be adjustably positioned to tighten or loosen belt 190.

First pulley system 26 is comprised of second and third secondary drive pulleys 184 and 186, respectively, and cylinder 122 which is a part of drum supporting ring member 112. Pulleys 184 and 186 drive cylinder 122 with belts 196 and 198. Idler pulley 200 is rotatingly fastened on a pivotable lever 202 fastened to bracket 180. Extension spring 204 is attached between lever 202 and bracket 206 at a location which allows spring 204 to pull idler pulley 200 into belts 196 and 198 in a tensioning fashion. Bracket 206, apparent to those skilled in the art, is fastened between forward, lower end member 52 and a support 56.

As shown in FIG. 4, second pulley system 28 is also rotatingly driven by shaft 24. A fourth secondary drive pulley 208 is fastened to shaft 24 rearwardly of bracket 180 at the output end of apparatus 10. Idler pulley 210 is aligned with drive pulley 208 and is rotatingly attached to a rear support 60. Large driven pulley 212 is fastened to central shaft 16. A tension-producing, idler pulley 214 is rotatingly fastened on a pivotable lever 216 extending downwardly from attachment with upper end member 58. Belt 218 is wrapped substantially around pulley 212, over idler pulley 214, under drive pulley 208 and over pulley 210 so as to drive pulley 212 in a direction opposite the rotational direction of cylinder 122. A compression spring 220 is fastened between a bracket 222 and lever 216 to force pulley 214 into a tensioning relationship with belt 218. Bracket 222 is attached to extend downwardly from upper end member 58.

Thus, motor 22 drives shaft 24 which in turn drives auger 42 and inner and outer drums 18 and 20, respectively. Auger 42 and inner and outer drums 18 and 20 are driven at preferable rotational speeds relative to the rotational speed of motor 22 by applying commonly known engineering equations and principles to determine diameters for the various pulleys. It is preferable for inner drum 18 to rotate at a speed of approximately 200–290 surface feet per minute, depending on the portion of the cone considered. It is preferable for outer drum 20 to rotate at a speed of approximately 273 surface feet per minute. In this manner the surface speeds of drums 18 and 20 are approximately the same.

As shown by the arrows in FIGS. 3 and 4, first and second pulley systems 26 and 28, respectively, cause inner and outer drums 18 and 20, respectively, to rotate in opposite directions simultaneously. That is, motor 22 is shown to rotate clockwise as viewed from the front of apparatus 10. A clockwise rotation of motor 22 causes shaft 24 to rotate clockwise which in turn causes cylinder 122 and outer drum 20 to rotate clockwise. Shaft 24 rotates counter-clockwise when viewed from the back of apparatus 10 as shown in FIG. 4. With belt 218 wrapped about pulleys 208 and 210 in a backward S fashion, pulley 212 and inner drum 18 are caused to rotate clockwise when shaft 24 rotates counter-clockwise. Thus, inner and outer drums 18 and 20 rotate in opposite directions simultaneously.

In operation, apparatus 10 is hitched with tongue 68 to a tractor or other vehicle and positioned such that grain falling from the output end 48 of outer drum 20 falls into a receptacle including apparatus to transmit the clean grain to a storage bin or other facility. Jack mechanism 72 is operated to elevate the forward end of apparatus 10 to incline downwardly the axis of outer drum 20 so that grain will flow at an optimal rate under the force of gravity from the input end 46 to the output end 48 of outer drum 20. Tongue 68 is slidingly removed from sleeve 71 upon the extraction of pin 75. An auger mechanism such as shown in FIG. 1 and designated generally as 30 is positioned to receive grain and transmit it to pan 32. With motor 22 running so that inner and outer drums 18 and 20, respectively, are rotating counter to one another and auger 42 is operating, dirty grain is deposited into pan 32. The dirty grain flows from pan 32 in the input end 34 of inner drum 18. Grain and fine foreign materials pass through the screen of inner drum 18 and fall onto outer drum 20. Coarse foreign materials ride along the top of the dirty grain in inner drum 18 toward the output end 36 of inner drum 18. The coarse foreign materials gather along the bottom and somewhat up the rotational leading side of trash screen 146. Chute 38 rotates in conjunction with trash screen 146 and outer drum 20. As illustrated in FIG. 6, chute 38 scoops the course foreign materials which are tumbling in trash screen 146 each time chute 38 rotates downwardly from the horizontal. As chute 38 reaches a more vertical orientation, the coarse foreign materials fall into trough 40.

The grain dropping from inner drum 18 generally drops from the rotationally leading side of inner drum 18. Since outer drum 20 is rotating in a direction opposite from inner drum 18, the grain, once received in outer drum 20, rotates downwardly to the bottom and then somewhat up the rotationally leading side of outer drum 20. The counterrotation of inner and outer drums 18 and 20, respectively, thus results in grain being evenly distributed across the bottom of outer drum 20. Fine foreign materials pass through screen 115 in outer drum 20 and drop into trough 40. The cleaned grain flows under the force of gravity to the output end 48 of outer drum 20 and drops from apparatus 10. Fine and coarse foreign materials in trough 40 are forced by auger 42 toward opening 44 from which they exit apparatus 10.

While a preferred embodiment of the present invention has been described to indicate numerous characteristics and advantages, together with details of structure and function, the novel features of the invention are pointed out in the appended claims. It is to be understood that the disclosure is illustrative only, and that changes may be made in detail, especially in manners of shape, size and arrangement of parts, within the principle of the invention, to the full extent extended by the broad general meaning of the terms in which the appended claims are expressed.

What is claimed is:

1. An apparatus for cleaning dirty grain comprising:

a frame;

first screen means, attached rotatably to said frame, for receiving said dirty grain and separating coarse foreign materials from said grain, said first screen means having input and output ends;

second screen means, encircled about said first screen means and attached rotatably to said frame, for receiving said grain from said first screen means and separating fine foreign materials from said grain, said second screen means having input and output ends and an internal periphery therebetween;

means for rotating said first and second screen means simultaneously in opposite directions;

means for advancing said grain in a longitudinal direction from the input end of said first screen means to the output end of said second screen means; and means for removing the coarse foreign materials from said apparatus within the longitudinal distance between the input end of said first screen means and the output end of said second screen means, said removing means being attached to said internal periphery of second screen means adjacent said output end of said first screen means; whereby said dirty grain at the input end of said first screen means is cleaned of coarse and fine foreign materials as it advances to the output end of said second screen means.

2. An apparatus in accordance with claim 1 wherein said removing means includes chute means, adjacent the output end of said first screen means, for directing coarse foreign materials from said first screen means through said second screen means, whereby the coarse foreign materials may be removed from said apparatus.

3. An apparatus in accordance with claim 2 wherein said chute means includes inner and outer concentric ring members with a chute member having open ends extending therebetween, said outer ring member being attached to said second screen means, said inner ring member having a disk closure member attached at an end thereof to prevent coarse materials from passing through said inner ring, whereby coarse materials are received from said first screen means which is turning in a first direction and discharged through said chute member and said second screen means which is turning in a direction opposite said first direction.

4. An apparatus in accordance with claim 1 wherein said first screen means includes an inner drum having a surface and said second screen means includes an outer drum having a surface and wherein said rotating means includes first means for turning said inner drum at a first speed and second means for turning said second drum at a second speed, said first and second speeds resulting in roughly equivalent speeds for the surfaces of said inner and outer drums, respectively, whereby grain is separated from foreign materials at roughly equivalent rates by said inner and outer drums.

5. An apparatus in accordance with claim 4 wherein the surface of said inner drum is frusto-conically shaped and the surface of said outer drum is cylindrically shaped, said inner drum being farther separated from said outer drum as grain moves from input to output ends of said first and second screen means.

6. An apparatus for cleaning dirty grain comprising:

a frame;

a support shaft disposed substantially horizontal and attached rotatably to said frame;

first screen means, attached to said support shaft, for receiving said dirty grain and separating coarse foreign materials therefrom, said first screen means being frusto-conically shaped with larger and smaller ends and a conical side therebetween, the larger and smaller ends being input and output ends, respectively;

second screen means, rotatably supported on said support shaft, for receiving said grain from said first screen means and separating fine foreign materials from said grain, said second screen means being cylindrically shaped and encircled about said first screen means, said first and second screen means having a common axis, said second screen means having input and output ends, said second screen means including a plurality of ring members with first and second ring members forming the input and output ends, respectively, of said second screen means, said second screen means having a cylindrical third ring member located between said first and second ring members, said second screen means further including a plurality of longitudinally-extending, rotationally spaced-apart straight members fastened to said ring members with said second screen fitting about and being supported on said ring and straight members, said straight members causing said grain to tumble as said second screen means rotates;

first pulley means for rotating said first screen means in one direction;

second pulley means for rotating said second screen means in a direction opposite the rotational direction of said first screen means;

motor means for driving said first and second pulley means;

means for elevating the input ends of said first and second screen means with respect to the output ends so that the gravitational force may aid the flow of said grain from the input end of said first screen means to the output end of said second screen means; and chute means, adjacent the output end of said first screen means, for directing coarse foreign materials from said first screen means through said second screen means; said chute means including a screen ring and means for supporting said screen ring concentrically within the cylindrical wall of said third ring member, said screen ring having a diameter somewhat greater than the smaller end of said first screen means, said screen ring having one end overlying a portion of the smaller end of said first screen means, said screen ring having a cover opposite the end overlying said first screen means, said chute means including an open-ended, rectangular box attached to and extending between said screen ring and the cylindrical wall of said third ring member, said screen ring and the cylindrical wall of said third ring member having openings matching the open ends of said box;

whereby dirty grain is cleaned of coarse and fine foreign materials between the input end of said first screen means and the output end of said second screen means.

7. An apparatus in accordance with claim 6 wherein said box has a plurality of sides including a rotationally-leading side, an open inner end perpendicular to the sides, and an open outer end arcuately shaped for a flush fit with said third ring, said box being parallel to and offset in the rotationally-leading direction of said second screen means from a radial line extending from the common axis of said first and second screen means, the rotationally-leading side of said box being flush with said screen ring.

8. An apparatus for cleaning dirty grain comprising:

a frame;

a support shaft disposed substantially horizontal and attached rotatably to said frame;

a frusto-conical screen drum attached to said support shaft and having input and output ends, said frusto-conical screen drum including a larger ring member at the input end, a smaller ring member at the output end, a plurality of rotationally spaced-apart straight members for tumbling said grain extending between the outer circumference of said larger and smaller rings, and a first screen formed in a frusto-conical shape about said plurality of first straight members, said first screen being meshed wire with perforations sufficiently large to pass grain therethrough;

a cylindrical screen drum rotatably supported on said support shaft and having input and output ends, said cylindrical screen drum including longitudinally spaced-apart, first, second, and third ring members, a plurality of rotationally spaced-apart second straight members for tumbling said grain extending between the outer circumference of said first, second, and third ring members, and a second screen formed in a cylindrical shape and fitted about said plurality of straight members, said second screen being meshed wire with perforations sufficiently small to prevent said grain from passing therethrough while allowing foreign materials smaller than said grain to pass therethrough, said first and second ring members forming the input and output ends, respectively, of said cylindrical screen drum, said first ring member including a cylindrical portion extending forwardly beyond the input end of said frusto-conical screen drum, said third ring member located between the output end of said frusto-conical screen drum and said second ring member, said third ring member including an outer cylindrical wall, a screen ring, and means for supporting said screen ring concentrically within said outer cylindrical wall, said screen ring having a diameter somewhat greater than the diameter of the smaller ring member of said frusto-conical drum, said screen ring overlying at one end the smaller ring member and having a cover at another end, said third ring member including an open-ended, rectangular box attached to and extending between said screen ring and said outer cylindrical wall, said box being parallel to and offset in the rotationally-leading direction of said cylindrical screen drum from a radial line extending from said support shaft, said box being a removal chute for large foreign materials passing out the output end of said frusto-conical screen;

a jack attached to said frame for elevating the input end of said cylindrical screen drum to aid grain to flow from the input end to the output end under the influence of the gravitational force;

a motor having a primary drive shaft and a primary drive pulley fastened to said primary drive shaft, said motor attached to said frame;

a secondary drive shaft rotatably attached to said frame having a primary driven pulley and at least first and second secondary drive pulleys atached thereto;

a primary drive belt for rotatably coupling to said primary drive and driven pulleys;

a first secondary driven pulley aligned with said first secondary drive pulley and fastened to said support shaft;

a first secondary belt for rotatably coupling said first secondary drive and driven pulleys and driving said frusto-conical screen drum in one direction; and a second secondary belt for rotatably coupling said second secondary drive pulley and the cylindrical portion of the first ring member of said cylindrical screen drum for driving said cylindrical screen drum in the direction opposite said frusto-conical screen drum.

9. An apparatus for cleaning dirty grain comprising:

a frame;

a support shaft disposed substantially horizontal and attached rotatably to said frame;

first screen means, attached to said support shaft, for receiving said dirty grain and separating coarse foreign materials therefrom, said first screen means being frusto-conically shaped with larger and smaller ends and a conical side therebetween, the larger and smaller ends being input and output ends, respectively;

second screen means, rotatably supported on said support shaft, for receiving said grain from said first screen means and separating fine foreign materials from said grain, said second screen means being cylindrically shaped and encircled about said first screen means, said first and second screen means having a common axis, said second screen means having input and output ends;

first pulley means for rotating said first screen means in one direction;

second pulley means for rotating said second screen means in a direction opposite the rotational direction of said first screen means;

motor means for driving said first and second pulley means, said motor means including a motor with a primary drive shaft, a secondary drive shaft for driving said first and second pulley means, a primary drive pulley fastened to said primary drive shaft, a primary driven pulley fastened near a first end to said secondary drive shaft and aligned with said primary drive pulley, and a primary belt for rotatably coupling said primary drive and driven pulleys, the axis of said primary drive shaft and the axis of said secondary drive shaft being substantially parallel, said motor being fastened and said secondary drive shaft being rotatably fastened to said frame, whereby said motor rotatingly drives said secondary drive shaft and thereby drives said first and second pulley means.

10. An apparatus in accordance with claim 9 wherein said first pulley means includes a first secondary drive pulley fastened to said secondary drive shaft, said first pulley means further including a first secondary driven pulley aligned with said first secondary drive pulley and fastened to said support shaft, said first pulley means further including a first secondary belt for rotatably coupling said first secondary drive and driven pulleys and at least one idler pulley yieldably and rotatably attached to said frame, said idler pulley for applying tension to said first secondary belt, whereby said secondary drive shaft drives said support shaft and thereby said first screen means.

11. An apparatus in accordance with claim 10 wherein said secondary drive shaft extends at a second end beyond the input end of said first and second screen means, wherein said second pulley means includes a second secondary drive pulley fastened near the second end of said secondary drive shaft, and wherein said second screen means includes a ring member at its input end, said ring member including a cylindrical portion aligned with said second secondary drive pulley, said second pulley means further including a second secondary belt for rotatably coupling said second secondary drive pulley and the cylindrical portion of said ring member, said second pulley means including an idler pulley yieldably and rotatably attached to said frame for applying tension to said second secondary belt, whereby said driven shaft drives said ring member and thereby said second screen means.

* * * * *

UNITED STATES PATENT AND TRADEMARK OFFICE

CERTIFICATE OF CORRECTION

PATENT NO. : 4,312,750

DATED : January 26, 1982

INVENTOR(S) : BRAUN, KEITH A. and JOHANNSEN, JOHN F.

It is certified that error appears in the above—identified patent and that said Letters Patent is hereby corrected as shown below:

Column 7, line 49, delete "62" and insert therefor --162--.

Signed and Sealed this

*Eighteenth* Day of *May 1982*

[SEAL]

*Attest:*

GERALD J. MOSSINGHOFF

*Attesting Officer*

*Commissioner of Patents and Trademarks*